US005916323A

United States Patent [19]

Bellina

[11] Patent Number: 5,916,323

[45] Date of Patent: Jun. 29, 1999

[54] PRESSURE WIRE DRAWING TOOL WITH DETACHABLE PRESSURE AND DRAWING DIES

[75] Inventor: Ferruccio Bellina, Milan, Italy

[73] Assignee: Tecnovo S.r.l. Milano, Milan, Italy

[21] Appl. No.: 09/003,384

[22] Filed: Jan. 6, 1998

[51] Int. Cl.[6] ..... B21C 3/12

[52] U.S. Cl. ..... 72/467; 72/274

[58] Field of Search ..... 72/467, 274, 253.1

[56] References Cited

U.S. PATENT DOCUMENTS

| | | | |
|---|---|---|---|
| 2,544,302 | 3/1951 | Duncan | 72/467 |
| 3,740,990 | 6/1973 | Prajsnar | 72/467 |
| 5,402,664 | 4/1995 | Sarver | 72/467 |

FOREIGN PATENT DOCUMENTS

| | | | |
|---|---|---|---|
| 799854 | 1/1981 | U.S.S.R. | 72/274 |
| 845927 | 7/1981 | U.S.S.R. | 72/274 |
| 1161212 | 6/1985 | U.S.S.R. | 72/467 |
| 1304954 | 4/1987 | U.S.S.R. | 72/467 |
| 1416228 | 8/1988 | U.S.S.R. | 72/467 |
| 1666240 | 7/1991 | U.S.S.R. | 72/467 |
| 2077647 | 12/1981 | United Kingdom | 72/274 |

*Primary Examiner*—Daniel C. Crane

*Attorney, Agent, or Firm*—Randall J. Knuth, P.C.

[57] ABSTRACT

A tool suited to the pressure wire drawing of wire rods and wires having a hole passing through it, includes a casing detachably disposed within the casing, a wire drawing nib separate from the pressure die and detachably disposed within the casing and aligned with the above mentioned hole, and at least one gasket between the wire drawing nib and the pressure die designed to make the passage formed between the pressure die and wire drawing nib leak-proof.

8 Claims, 2 Drawing Sheets

PRESSURE WIRE DRAWING TOOL WITH DETACHABLE PRESSURE AND DRAWING DIES

BACKGROUND OF THE INVENTION

1. Field of the Invention

The invention consists of a tool perfected and particularly suited to the pressure wire drawing of wire rods and wires, with a separate and detachable pressure die and drawing die.

2. Description of the Related Art

The operation of wire drawing, well known in the technical literature, consists of reducing the diameter of wire rods or wires by means of plastic deformation effected by a tool of appropriate shape known as a wire drawing die.

Wire is passed through the above mentioned tool by means of electrically driven bobbins so the diameter of the wire is reduced during this forced passage.

One critical aspect of the whole operation is that of lubrication of the wire, which must be optimum in order to prevent the tool from seizing. The length of the entrance cone of the wire drawing die, which acts as a pump for the lubricant due to the continuous movement caused by the sliding of the lubricant in the tool, improves the attachment of the lubricant to the wire, but there remain problems of sealing inside the wire drawing die itself.

One well-known solution in the technical literature is that of wire drawing dies consisting of a single wire drawing nib made of tungsten carbide encased by shrink-fitting in a case that is carefully shaped on the inside, altogether this constitutes one single piece which is filled directly on machines designed for wire drawing operations.

A more recent tool has a case of steel, in two parts, that can be taken apart, where the upper part is shaped on the inside to house a die known as a pressure die made of tungsten carbide, while the lower part is designed to contain a wire drawing nib, again made of tungsten carbide, designed to perform the plastic deformation or the wire rod or wire.

Although these devices meet the technical requirements described above, they nevertheless have the following disadvantages.

Once the tool consisting of a single piece is worn it must be completely replaced with an increase in total costs, since because of its components, the worn tool becomes a special waste requiring adequate disposal.

Furthermore, and again for reasons of cost, the dimensions of the tungsten carbide nib, which in this case cannot be recovered in any way, are reduced to the indispensable minimum with consequent negative results for lubrication. The quality of the finished product and the speed of production is thereby lowered.

Tools consisting of more than one part that can be assembled and taken apart present the inconvenience of the possibility of leakage of the lubricant between the pressure die and the drawing nib as well as that of the case yielding due to the high working pressures.

In this case too, costs are markedly increased because of both the mechanical breakages described above and the maintenance necessary to dismantle and replace damaged parts.

Production speed in this case too, may not be such as to exploit the maximum potential speed of wire drawing machines due to problems connected with lubrication caused by the above described leakages.

The purpose of this invention is to resolve these inconveniences inherent in the prior technology.

SUMMARY OF THE INVENTION

The invention consists therefore of a very reliable and long lasting tool perfected and particularly suited to the pressure wire drawing of wire rods and wires, with the pressure die and drawing die separate and detachable, which by optimizing lubrication increases production speeds, lowers costs and thereby improves the entire wire drawing operation.

Briefly, a tool perfected and particularly suited to the pressure wire drawing of wire rods and wires, with the pressure die and drawing die separate and detachable, according to the invention, has been created which comprises a hole passing through the tool, containing a pressure die and a wire drawing nib on the inside that are separate from each other and aligned on the above mentioned hole, where there is at least one gasket between the wire drawing nib inserted at the bottom of the above mentioned case and the pressure die located at the top of the case. The gasket is designed to make the passage between the above mentioned pressure die and the above mentioned wire drawing nib leak-proof.

With the new tool suited to the pressure wire drawing of wire rods and wires, with pressure die and drawing die separate and detachable according to the invention, the following advantages are obtained.

Lubrication is optimum and without leaks, allowing constantly faster production speeds and therefore a lower overall cost for the finished product.

Perfect lubrication also allows greater durability of the drawing nib which is the part most subject to wear because of the high operating pressures during the functioning of wire drawing machines, consequently maintenance intervention is required less frequently.

A further advantage of the invention is its absolute simplicity of manufacture allows the manufacturing costs of its various parts to remain almost unchanged in relation to those already existing for the parts available on the market.

The invention in one form comprises a tool suited to the pressure wire drawing of wire rods and wires having a hole passing through it, includes a casing detachably disposed within the tool, a wire drawing nib separate from the pressure die and detachably disposed within the casing and aligned with the above mentioned hole, and at least one gasket between the wire drawing nib and the pressure die designed to make the passage formed between the pressure die and wire drawing nib leak-proof.

Other characteristics, advantages and particulars of the tool particularly suited to the pressure wire drawing of wire rods and wires, with a separate and detachable pressure die and drawing die according to the invention, are better shown by an examination of the following description with reference to the attached drawings that show the two preferred forms of the invention. The said drawings are given purely for the sake of illustration and not to set limits on the invention.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
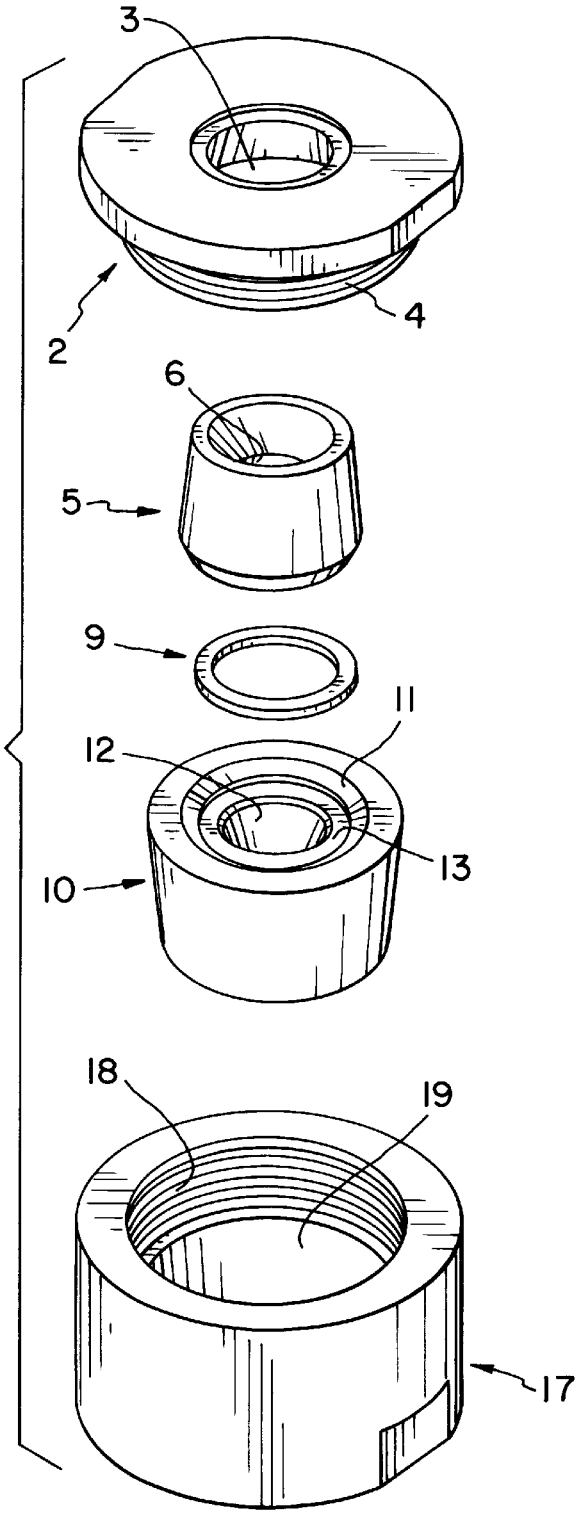
FIG. 1 contains an exploded perspective view of the first embodiment of the tool suited to the pressure wire drawing of wire rods and wires, according to the invention.
Figure 2:
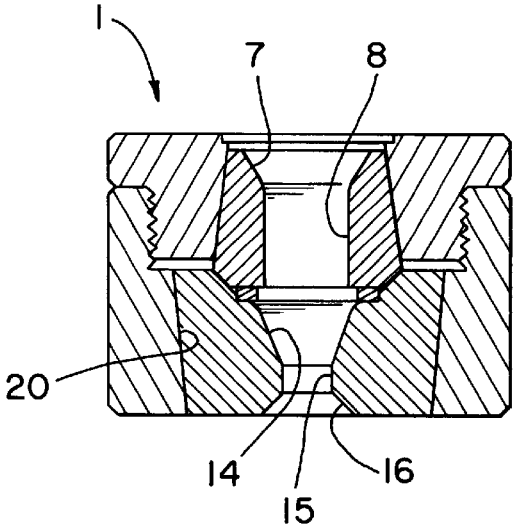
FIG. 2 contains a cross section view of the tool according to the invention illustrated in FIG. 1.

With reference to the numbers in FIGS. 1 and 2, a first design of the tool 1, particularly suited to the wire drawing of wire rods and wires according to the invention, comprises a case with a hole through the center, preferably made of steel, which has an upper part 2, and a lower part 17. The above mentioned upper part 2, has a central hole passing through it 3, this being the initial entrance for the wire or wire rod to be drawn and a thread on the outside 4, designed to fix in a detachable way onto the lower part 17.

Inside the upper part 2, a pressure die 5, usefully made of tungsten carbide is inserted. This pressure die has a hole 6, passing through the center of it, the upper section of which has a truncated cone shaped surface 7, which joins onto a subsequent cylindrical shaped surface 8.

Below the above mentioned pressure die 5, a wire drawing nib 10 is located appropriately inserted into the lower part 17, of the case of the device 1, according to the invention. This too is usefully made of tungsten carbide and is countersunk 11, at the top, joining onto a seating 13, that is specially designed to house a gasket 9.

The seating 13, then defines a central hole 12, passing through the wire drawing nib 10, which has an initial inner surface section 14, that has a truncated cone shaped and joins onto a subsequent cylindrical section 15 and terminates with a countersunk section 16.

The gasket 9, usefully made of copper, has the function of sealing the joint between the pressure die 5 and the wire drawing nib 10 under all operating conditions.

The lower part 17 has a cylindrical outer surface and a hole 19 passing through the center of it, with a thread 18 at the top to allow it, as described previously, to be connected to and detached from the upper part 2 and a truncated cone shaped section 20, at the bottom, designed to house the wire drawing nib 10.

Finally, it should be noted that once the tool according to the invention is assembled, the holes 3, 6, 12 and 19 are all perfectly aligned, each with the others.

Figure 4:
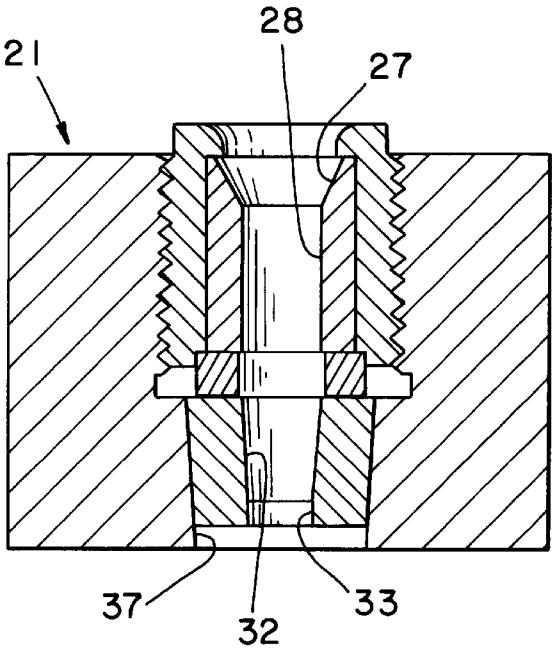
FIG. 4 contains a cross section view of the tool according to the invention illustrated in FIG. 3.
Figure 3:
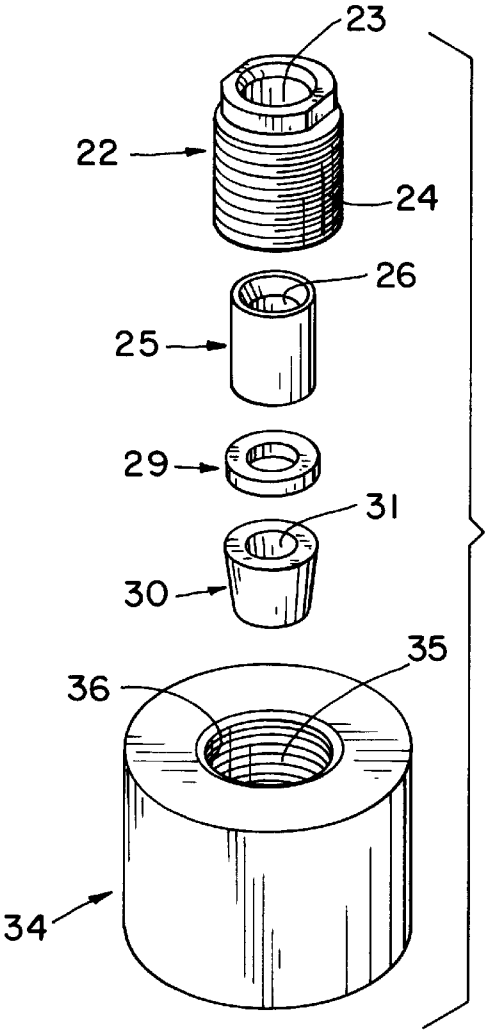
FIG. 3 contains an exploded perspective view of the second embodiment of the tool suited to the pressure wire drawing of wire rods and wires, according to the invention.

With reference to the numbers in FIGS. 3 and 4, a second design of the tool 21, particularly suited to the wire drawing of wire rods and wires according to the invention, comprises a case with a hole through the center, preferably made of steel, which has an upper part 22 and a lower part 34, which can be connected together and detached from each other.

The upper part 22 has a central hole passing through it, 23, this being the initial entrance for the wire or wire rod to be drawn and a thread on the outside 24.

The hole 23 is designed to house a pressure die 25, this too being usefully made of tungsten carbide. This pressure die has a hole 26 passing through the center of it, the upper section of which has a truncated cone shaped surface 27, which joins onto a subsequent cylindrical shaped surface 28.

A gasket 29, again made of copper separates the pressure die 25 from a wire drawing nib 30, made of tungsten carbide and also having a hole 31 passing through the center of it.

The above mentioned wire drawing nib 30 is inserted into the lower part 34, of the case of the tool 21, according to the invention and the above mentioned hole 31 has a truncated cone shaped inner surface 32 followed by a cylindrical shaped section, 33.

The lower part of the case 34 also has a central hole 35 passing through it with a thread on the inside allowing it to be joined to and detached from the above mentioned upper part 22 of the case. Finally, below the threaded section 36, the lower part of the case 34 has a truncated cone shaped section 37 designed to house the wire drawing nib 30.

In this case too, once the tool according to the invention has been assembled, the holes 23, 26, 31, and 35 passing through the component parts of the invention are all perfectly aligned each with the others.

Naturally the shape and dimensions of the various components of which the tool perfected and particularly suited to the pressure wire drawing of wire rods and wires, with the separate and detachable pressure die and drawing die according to the invention may differ according to differing requirements, but remain, however, within the concept of the invention described above.

Once assembled the tool 1 or 21, according to the invention, can be connected without any modification on any existing wire drawing machine.

The wire rod or wire to be drawn is inserted into the entrance hole 3, 23 of the upper part of the case and is passed through the tool 1, 21, according to the invention by means of electrically driven bobbins.

The lubricants mainly used such as oils, soaps and calcium or sodium stearates are also introduced through the entrance hole 3, 23, and are fed along the wire by means of the pump action generated by the continuous movement of the wire and the truncated cone section 7, 27 at the entrance of the pressure die 5, 25, immediately after the entrance hole 3, 23.

The copper gasket 9, 29, located between the pressure die 5, 25 and the drawing nib 10, 30, then prevents the above mentioned lubricant from escaping to the outside, keeping it as firmly attached as possible to the wire that is being drawn, thereby guaranteeing optimum lubrication. In fact the temperatures and pressures created inside the drawing nib 10, 30, during functioning are considerably different from those found inside the pressure die 5, 25, and consequently the deformation to which these two parts are subject is also different. The presence between them of a gasket 9, 29, made of a material with considerably different mechanical properties functions to seal the join between them by exploiting the difference in susceptibility to deformation of the material of which the above mentioned gasket 9, 29, is made and this perfectly compensates for the difference in deformation of the pressure die 5, 25, and the nib, 10, 30.

This also has the advantage of preventing the possible breakage, by bursting, of the outer steel case 1, 21, of the tool according to the invention.

The speed of current wire drawing machines can therefore be exploited to the maximum with all the consequent advantages previously described, because the inconveniences due to imperfect lubrication have been eliminated.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A tool suited to the pressure wire drawing of wire rods and wires, said tool having a hole passing through it comprising:

a case comprising an upper part threaded into a lower part to be detachably disposed with respect to one another, and a wire drawing nib separate from a pressure die and detachably disposed within said case and aligned with the above mentioned hole, both said wire drawinq nib and said pressure die being in direct contact with said case, said upper part having a central hole passing throuqh it and housing said pressure die therein so that a circumferential surface of the pressure die is contacted and retained by said upper part and said lower part having a hole passing through it and housing said wire drawing nib therein; and at least one gasket between said wire drawing nib and said pressure die designed to make the passage formed between said pressure die said wire drawing nib leakproof.

2. The tool according to claim 1, in which said hole passing through the center of said lower part has a truncated cone shaped section below said threaded surface.

3. The tool according to claim 1, in which said pressure die has a central hole passing through it, comprising a first section having a truncated cone shape, followed by a second cylindrical shaped section.

4. The tool according to claim 1, in which said wire drawing nib has a first section with a truncated cone shape followed by a second cylindrical shaped section.

5. The tool according to claim 4, in which said wire drawing nib is countersunk at its top followed by a seating designed to house said gasket, said wire drawing nib countersunk at its bottom.

6. The tool according to claim 1, in which said upper and lower parts of said case are made of steel.

7. The tool according to claim 1, in which said pressure die and said wire drawing nib are made of carbide tungsten.

8. The tool according to claim 1, in which said gasket is made of copper.

* * * * *